US008382954B2

(12) United States Patent
Sawada et al.

(10) Patent No.: US 8,382,954 B2
(45) Date of Patent: Feb. 26, 2013

(54) BELT FOR CONVEYING WET WEB

(75) Inventors: Takeshi Sawada, Tokyo (JP); Kenji Inoue, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 222 days.

(21) Appl. No.: 12/678,655

(22) PCT Filed: Sep. 17, 2008

(86) PCT No.: PCT/JP2008/066717

§ 371 (c)(1),
(2), (4) Date: May 28, 2010

(87) PCT Pub. No.: WO2009/038066

PCT Pub. Date: Mar. 26, 2009

(65) Prior Publication Data

US 2010/0282426 A1 Nov. 11, 2010

(30) Foreign Application Priority Data

Sep. 18, 2007 (JP) ..... 2007-241160

(51) Int. Cl.
*D21G 9/00* (2006.01)

(52) U.S. Cl. ..... 162/289

(58) Field of Classification Search ..... 162/289, 162/358.1, 306, 358.2, 358.4, 901; 428/297.4
See application file for complete search history.

(56) References Cited

U.S. PATENT DOCUMENTS

| | | | |
|---|---|---|---|
| 6,358,369 | B1 | 3/2002 | Yoshida et al. |
| 7,192,895 | B2 | 3/2007 | Ito |
| 2004/0154776 | A1 | 8/2004 | Inoue |
| 2004/0185729 | A1 | 9/2004 | Inoue |
| 2004/0266298 | A1 | 12/2004 | Ito |
| 2005/0167069 | A1 | 8/2005 | Kobayashi et al. |

FOREIGN PATENT DOCUMENTS

| | | |
|---|---|---|
| CN | 1519426 A | 8/2004 |
| JP | 2000 273786 | 10/2000 |
| JP | 2004 277971 | 10/2004 |
| JP | 2005 23450 | 1/2005 |
| JP | 2005 200819 | 7/2005 |
| JP | 2006 009207 | 1/2006 |
| JP | 2008 133579 | 6/2008 |

OTHER PUBLICATIONS

Chinese Office Action issued on Aug. 15, 2011, in Patent Application No. 200880106919.1 (with English translation).

*Primary Examiner* — Mark Halpern
(74) *Attorney, Agent, or Firm* — Oblon, Spivak, McClelland, Maier & Neustadt, L.L.P.

(57) ABSTRACT

A belt for wet-web conveyance which includes a hydrophilic fibrous structure formed by needle punching in a wet-web-side layer thereof and which can be inhibited from increasing in belt width dimension with water absorption of the hydrophilic fibrous structure and from forming base fabric marks. The belt for wet-web conveyance includes a wet-web-side layer including a hydrophilic fibrous structure and a machine-side layer. A base fabric disposed in the belt is constituted of a first woven fabric disposed on the wet-web side and, laminated therewith, a second woven fabric disposed on the press roll side. The first woven fabric is woven from a machine-direction yarn material and a cross-direction yarn material, the machine-direction yarn material being a spun yarn and the cross-direction yarn material being a yarn having a low water absorption.

19 Claims, 4 Drawing Sheets

BELT FOR CONVEYING WET WEB

This application is a 371 of PCT/JP2008/066717 filed 17 Sep. 2008

FIELD OF THE INVENTION

The present invention relates to a wet paper web transfer belt for transferring a wet paper web at high speed which is used in a closed-draw papermaking machine.

DESCRIPTION OF THE RELATED ART

Papermaking machines for removing moisture from the source material of paper are equipped with a wire part, a press part and a dryer part. These parts are disposed in the order of wire part, press part and dryer part along the direction in which the wet paper web is transferred.

In one type of papermaking machine, the wet paper web is passed from one part to another in an open-draw. In this open-draw papermaking machine, the wet paper web is not supported by a belt. As a result, the wet paper web tends to rupture in places where it passes from one part to another, which makes it difficult to operate this type of papermaking machine at high speed.

In recent years, most papermaking machines have therefore come to be of the type in which the wet paper web is passed in a closed-draw. In this closed-draw papermaking machine, the wet paper web is passed by transferring it while being placed on a wet paper web transfer belt. As a result, it has become possible to operate papermaking machines with safety and at high speed.

In such a closed-draw papermaking machine, the wet paper web is transferred while passing it from one part to another in the order of wire part, press part and dryer part. In the press part, the wet paper web is transferred by a wet paper web transfer belt while moisture is squeezed out (water squeezing) by a pressing device; thereafter, the wet paper web is dried in the dryer part.

In Patent document 1 (JP, A, 2004-277971), the present applicant has proposed a wet paper web transfer belt which combines a first function of attaching the wet paper web and of transferring the wet paper web with a second function of smoothly releasing the wet paper web when it is passed to the next process. In this wet paper web transfer belt, the wet paper web-side layer comprises a high-polymer elastic part and a fibrous body; the fibrous body is hydrophilic and one part of it is exposed on the surface.

The hydrophilic fibrous body exposed on the surface of the wet paper web-side layer retains the water from the wet paper web; therefore it performs the first function of attaching the wet paper web to the wet paper web transfer belt and of transferring the wet paper web. Furthermore, one part of the fibrous body is exposed on the surface of the wet paper web-side layer; therefore it performs the second function of smoothly releasing the wet paper web when it is passed to the next process.

Moreover, in Patent document 2 (JP, A, 2008-133579), the present applicant has proposed a wet paper web transfer belt wherein the dimensional extension of the belt width due to the water absorbing action of the hydrophilic fibrous body can be suppressed. In the inner part of this wet paper web transfer belt, a base fabric is provided which is made by stacking together a first woven fabric disposed on the wet paper web layer side and a second woven fabric disposed on the press roll side; wherein the weft yarns of either one, or of both, of the first and the second woven fabrics are of a yarn material with a low absorption rate.

Due to the weft yarns of this material, the dimensional extension of the belt width due to the water absorbing action of the hydrophilic fibrous body constituting the wet paper web-side batt layer can be suppressed.

[Patent document 1] JP, A, 2004-277971

[Patent document 2] JP, A, 2008-133579

DISCLOSURE OF THE INVENTION

Problems to be Solved by the Invention

The wet paper web transfer belt described in Patent document 1 combines the two functions mentioned above. Nevertheless, when one part of the moisture contained in the wet paper web is absorbed by the hydrophilic fibrous body (for example rayon fibers) of the wet paper web-side layer, the fibrous body expands and, consequently, the dimension of the wet paper web transfer belt becomes unstable. In particular, since the travelling speed of wet paper web transfer belts has increased in recent years, there is a need to suppress the dimensional extension of the belt width due to the water absorption of the hydrophilic fibrous body.

Furthermore, when, in the wet paper web transfer belt described in Patent document 1, the above-mentioned hydrophilic fibrous body of the wet paper web-side layer absorbs water and expands, the so-called phenomenon of base fabric marking occurs when the wet paper web-side layer of the belt becomes soft and the pattern of the base fabric structure is transferred to the wet paper web, which has a negative effect on the paper quality.

When, in the case of the wet paper web transfer belt described in Patent document 2, pressure is applied in the press part, base fabric markings appear in the wet paper web when the shape of the knuckles (the up and down of the CMD yarn material in relation to the MD yarn material) of the lower fabric (the second woven fabric) is transferred to the wet paper web, which has a negative effect on the paper quality.

The object of the present invention is to solve such problems and to provide a wet paper web transfer belt wherein the dimensional extension of the belt width and base fabric marking due to the water absorbing action of the hydrophilic fibrous body can be suppressed when, in order to improve the first function of attaching the wet paper web to the wet paper web transfer belt and of transferring the wet paper web and the second function of smoothly releasing the wet paper web when it is passed to the next process, a hydrophilic fibrous body is formed by needle punching in the wet paper web-side layer of the wet paper web transfer belt.

Means for Solving the Problems

The present inventor has become aware of the problem that, since a hydrophilic fibrous body (for example rayon fibers) is included in the wet paper web-side layer of the wet paper web transfer belt, there is a dimensional extension of the belt width due to the water absorbing action of the hydrophilic fibrous body and base fabric markings occur in the wet paper web. The present inventor has then completed the present invention in order to suppress the dimensional extension of the belt width and the base fabric markings.

In order to achieve the above-mentioned objectives, a wet paper web transfer belt according to the present invention is a belt for transferring a wet paper web used in a closed-draw papermaking machine, which comprises a base fabric disposed inside of said belt as well as a wet paper web-side layer disposed on the wet paper web-side, which includes a hydrophilic fibrous body, and a machine-side layer disposed on the press roll.

The above-mentioned base fabric is made by stacking together a first woven fabric disposed on the wet paper side and a second woven fabric disposed on the press roll side; wherein the first woven fabric is woven from a machine direction (MD) yarn material and a cross machine direction (CMD) yarn material, the MD yarn material is a complex yarn, and the CMD yarn material is a yarn material of a low water absorption rate. Furthermore, in the wet paper web transfer belt according to the present invention, the above-mentioned complex yarn is made from a short fiber yarn (spun yarn), a long fiber yarn (filament yarn) or a combined filament yarn in which the short fiber yarn (spun yarn) and the long fiber yarn (filament yarn) are twisted together comprising one or a plurality of materials selected from the group consisting of polyamide, polyester, aromatic polyamide, aromatic polyester and polyether ketone, and the above-mentioned CMD yarn material is preferably a yarn comprising one or a plurality of materials selected from the group consisting of polyamide, polyester, aromatic polyamide, aromatic polyester and polyether ketone.

Moreover, according to one preferred embodiment of the present invention, the above-mentioned first woven fabric consists of a single weave and the above-mentioned second woven fabric consists of a double weave. According to another preferred embodiment, the first woven fabric may also consist of a double weave and the second woven fabric may consist of a triple weave. According to still another preferred embodiment, the first woven fabric may also consist of a single weave and the second woven fabric may consist of a triple weave.

Advantages of the Invention

With a wet paper web transfer belt according to the present invention having the above-mentioned constitution, the dimensional extension of the belt width and base fabric marking due to the water absorbing action of the hydrophilic fibrous body can be suppressed when, in order to improve the first function of attaching the wet paper web to the wet paper web transfer belt and of transferring the wet paper web and the second function of smoothly releasing the wet paper web when it is passed to the next process, a hydrophilic fibrous body is formed by needle punching in the wet paper web-side layer of the wet paper web transfer belt.

EXPLANATION OF THE REFERENCE CHARACTERS

| | |
|---|---|
| 1, 1a, 1b | Wet paper web transfer belt |
| 2 | Closed-draw papermaking machine |
| 10 | Press roll |
| 30 | Hydrophilic fibrous body |
| 31 | wet paper web-side layer |
| 32 | machine-side layer |
| 33, 33a, 33b | base fabric |
| 34 | First woven fabric |
| 35 | Second woven fabric |
| 36 | Weft yarn |
| 37 | Surface |
| W | Wet paper web |

BEST MODE FOR CARRYING OUT THE INVENTION

Hereinafter, wet paper web transfer belts according to the present invention will be described.

Figure 1:
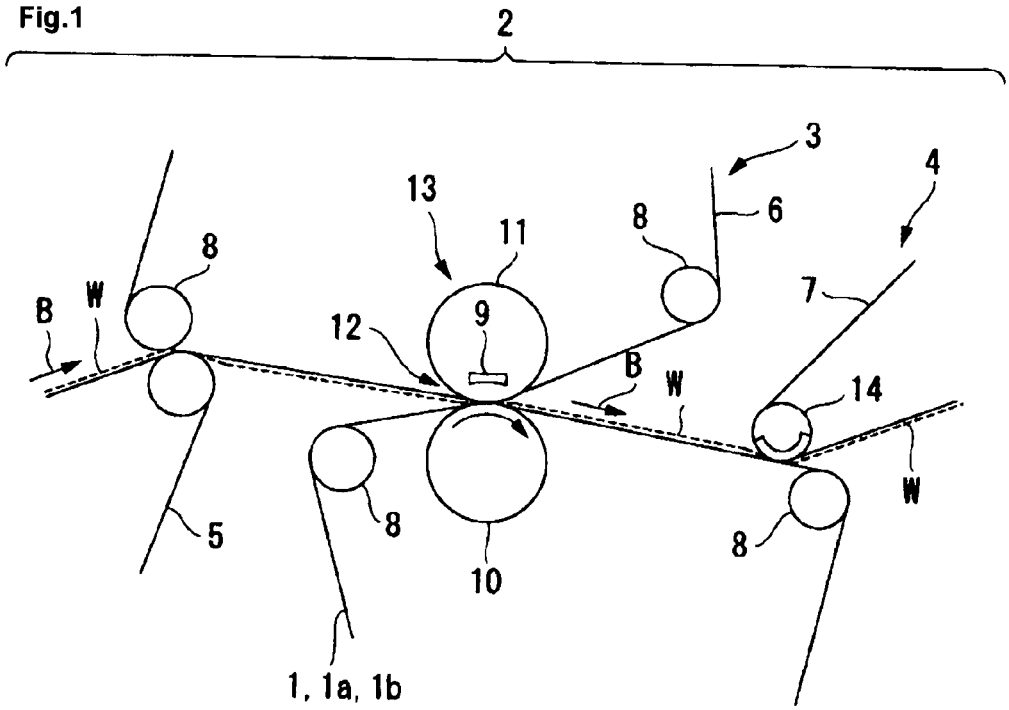
FIG. 1 A schematic view of a closed-draw papermaking machine in which a wet paper web transfer belt according to the present invention is used.

FIGS. 1 through 6 are views which are illustrative of the present invention. FIG. 1 is a schematic view of a closed-draw papermaking machine in which a wet paper web transfer belt according to the present invention is used.

As shown in FIG. 1, a closed-draw papermaking machine (hereinafter referred to as "papermaking machine") 2 for removing moisture from the source material of paper is equipped with a wire part (not shown), a press part 3 and a dryer part 4. These parts are disposed in the order of wire part, press part 3 and dryer part 4 along the direction in which the wet paper web is transferred (the direction indicated by the arrow B).

The wet paper web W is transferred by being passed successively through the wire part, the press part 3 and the dryer part 4. After water is squeezed out of the wet paper web W in the press part 3, the wet paper web W is finally dried in the dryer part 4. A wet paper web transfer belt (hereinafter referred to as "belt") 1 is provided in the press part 3 of the papermaking machine 2 and is used for transferring the wet paper web W in the direction of the arrow B.

The wet paper web W is supported by press felts 5, 6, the belt 1 and a dryer fabric 7, respectively, and is transferred in the direction indicated by the arrow B. The press felts 5, 6, the belt 1 and the dryer fabric 7 are each made in the shape of an endless belt which is supported by guide rollers 8.

A shoe 9 is of a concave shape corresponding to a press roll 10. The shoe 9 and the press roll 10, with a shoe press belt 11 interposed therebetween, constitute a press part 12.

A shoe press mechanism 13 comprises a press roll 10 and the shoe 9 provided above (or below) the press roll 10. The shoe press belt 11 is disposed between the press roll 10 and the shoe 9 and travels while in rotation. The press part 3 of the papermaking machine 2 is constituted by disposing a plurality of shoe press mechanisms 13 in series along the direction in which the wet paper web W is transferred (the direction indicated by the arrow B).

After the wet paper web W is transferred from the wire part (not shown) to the press part 3, it is passed from the press felt 5 to the press felt 6. The wet paper web W is then transferred to the press region 12 of the shoe press mechanism 13 by the press felt 6.

In the press part 12, the wet paper web W, sandwiched between the press felt 6 and the belt 1, is compressed by the shoe 9 and the press roll 10 with the shoe press belt 11 interposed therebetween. As a result, moisture in the wet paper web W is squeezed out.

The press felt 6 is configured to be of high water permeability, and the belt 1 is configured to be of low water permeability. Therefore, in the press part 12, moisture in the wet paper web W moves to the press felt 6. In the press part 3, the wet paper web W is thus dewatered while its surface is smoothened.

Immediately after leaving the press part 12, the respective volumes of the wet paper web W, the press felt 6 and the belt 1 expand because of a sudden release from pressure. Due to this expansion and the capillary action of the pulp fibers constituting the wet paper web W, the so-called "re-wetting phenomenon" occurs during which a part of the moisture in the press felt 6 moves to the wet paper web W.

Nevertheless, since the belt 1 is of low water permeability, the amount of moisture it can retain is small. Therefore, re-wetting during which water moves from the belt 1 to the wet paper web W substantially does not occur; the belt 1 thus contributes to an increase in the smoothness of the wet paper web W.

The wet paper web W which has passed through the press part 12 is transferred by the belt 1 in the direction indicated by the arrow B. The wet paper web W is then attracted to a suction roll 14 and is transferred by the dryer fabric 7 to the dryer part 4, where it is dried.

The belt 1 is required to have a first function of positively attaching the wet paper web W to the belt surface immediately after the wet paper web W leaves the press part 12. The belt 1 is also required to have a second function of smoothly releasing the wet paper web W from the belt 1 when the wet paper web W is passed to the next process (here, the dryer part 4).

Next, the belt 1 will be described below.

Figure 2:
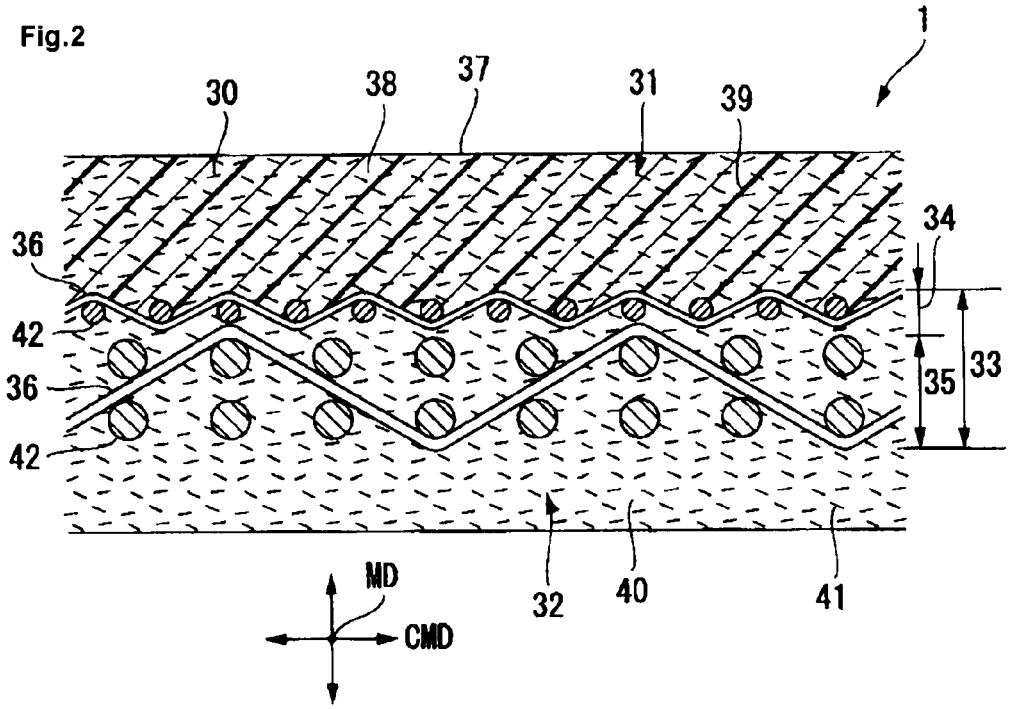
FIG. 2 A cross-sectional view of a wet paper web transfer belt according to a first embodiment of the present invention.
Figure 3:
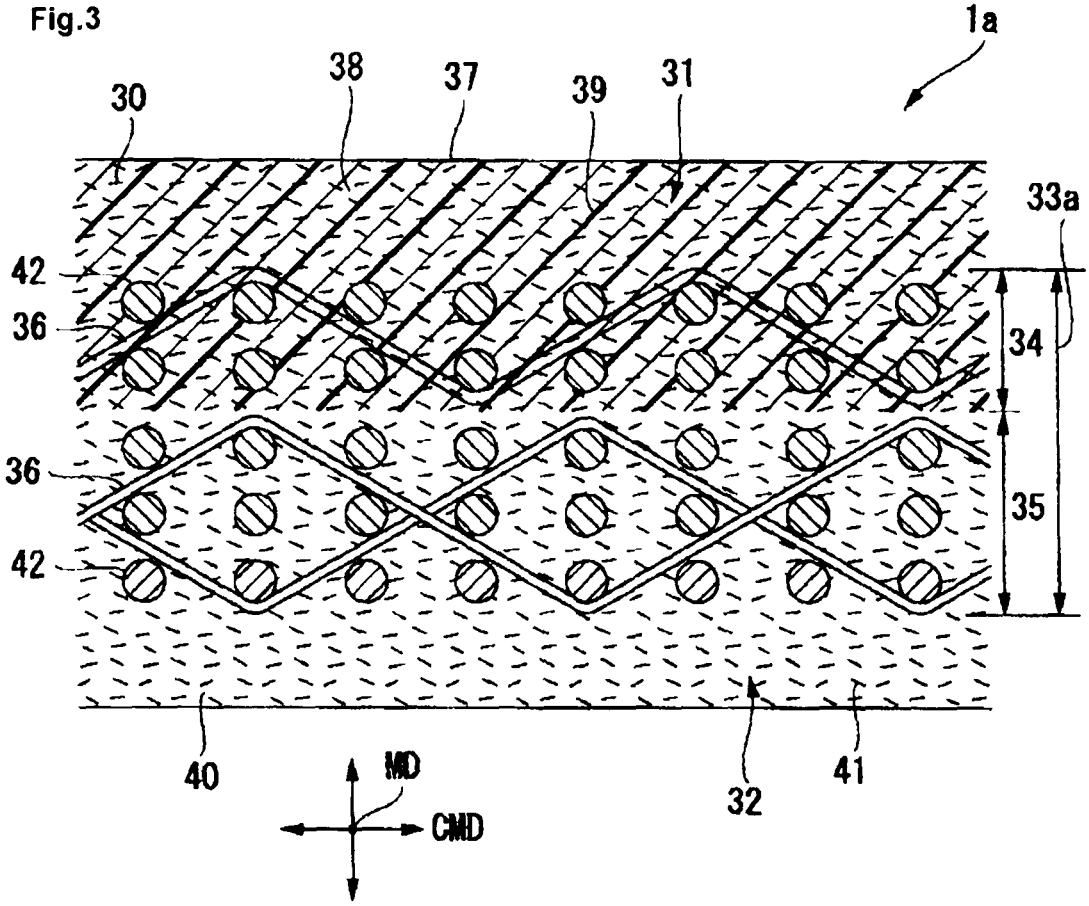
FIG. 3 A cross-sectional view of a wet paper web transfer belt according to a second embodiment of the present invention.
Figure 4:
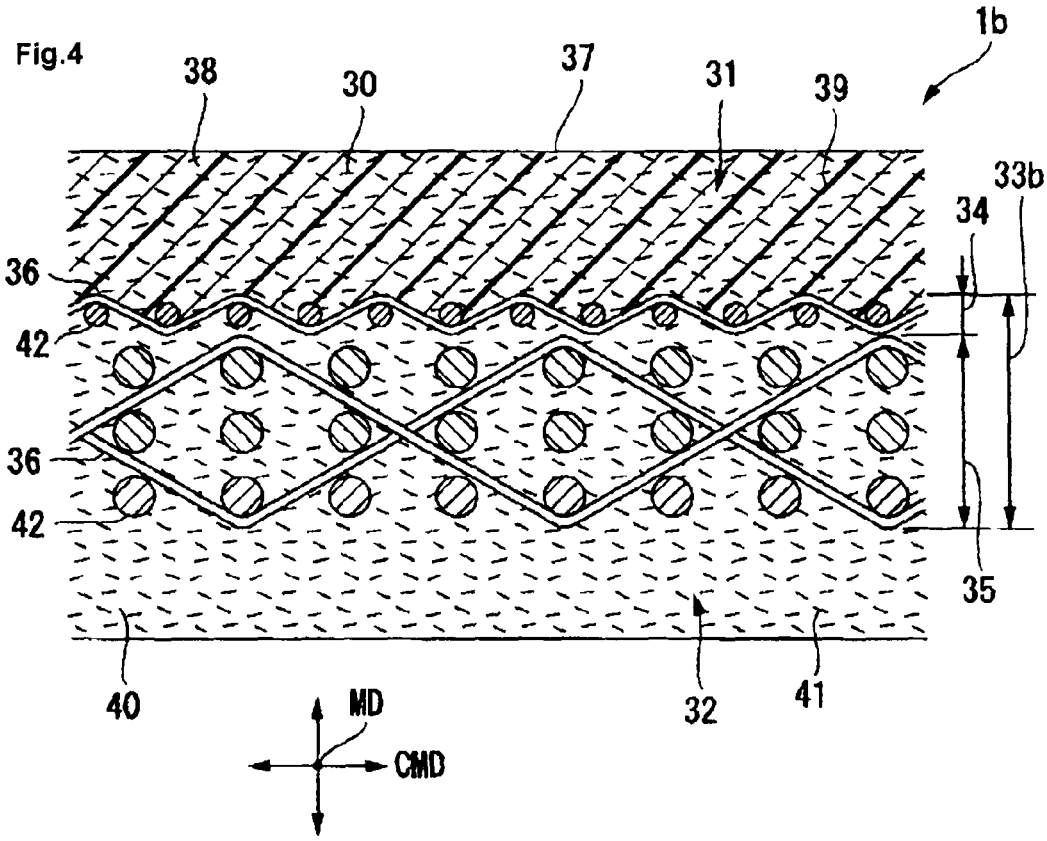
FIG. 4 A cross-sectional view of a wet paper web transfer belt according to a third embodiment of the present invention.
Figure 5:
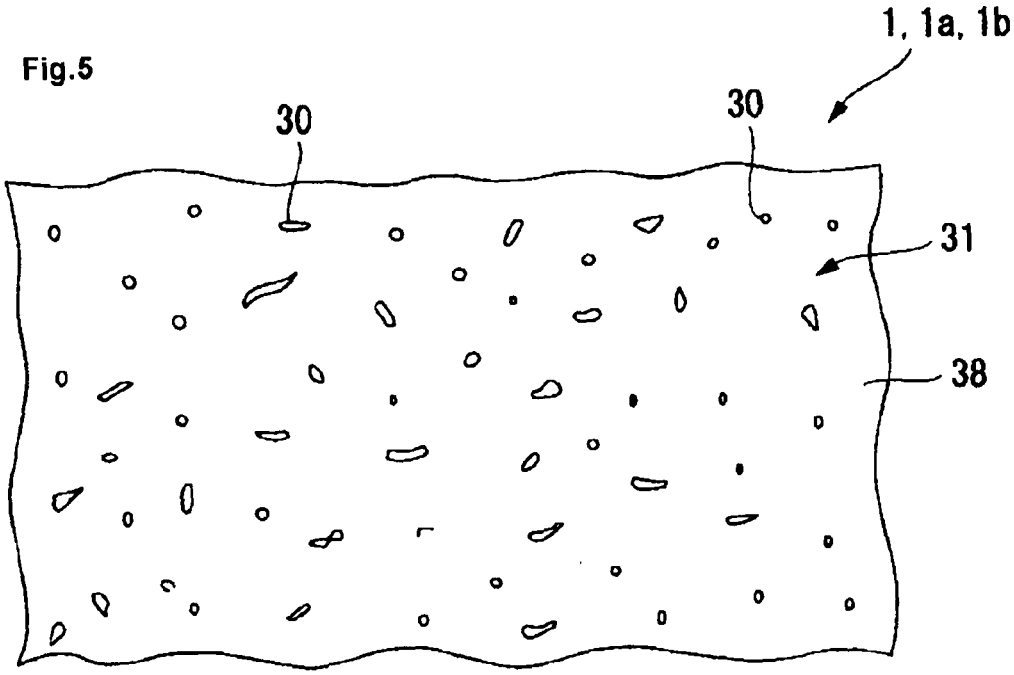
FIG. 5 A plain view of a wet paper web transfer belt.

FIG. 2 is a cross-sectional view of a belt 1 according to a first embodiment of the present invention. FIG. 3, which corresponds to FIG. 2, is a cross-sectional view of a wet paper web transfer belt 1*a* (hereinafter referred to as "belt 1*a*") according to a second embodiment of the present invention. FIG. 4, which corresponds to FIG. 2, is a cross-sectional view of a wet paper web transfer belt 1*b* (hereinafter referred to as "belt 1*b*") according to a third embodiment of the present invention. FIG. 5 is a plain view of belts 1, 1*a* and 1*b*.

In FIGS. 1 through 5, the belts 1, 1*a* and 1*b* have the prescribed dimension of the cross machine direction (CMD) and travel in the machine direction (MD) with the wet paper web W placed on an upper surface thereof.

The belts 1, 1*a*, 1*b* have a wet paper web-side layer 31, which includes a hydrophilic fibrous body 30 and which is disposed on the wet paper web W side, and a machine-side layer 32, which is disposed on the press roll 10 side. Inside the belts 1, 1*a*, 1*b*, base fabrics 33, 33*a*, 33*b* are provided. The belts 1, 1*a*, 1*b* are made entirely as laminar structures with the wet paper web-side layer 31 and the machine-side layer 32 respectively disposed on each side of the base fabrics 33, 33*a*, 33*b*.

The "hydrophilic property" of the hydrophilic fibrous body 30 refers to the property of attracting water and/or the property of retaining water. According to the present invention, the hydrophilic characteristics are represented by the "official moisture regain" specified in JIS L0105 (general principles of physical testing methods for textiles).

The base fabrics 33, 33*a*, 33*b* are made by stacking together a first woven fabric 34, disposed on the wet paper web W side, and a second woven fabric 35, disposed on the press roll 10 side.

At least one part of the hydrophilic fibrous body 30 is exposed on the surface 37 of the wet paper web-side layer 31. Here, the term "exposed" refers to a state in which the hydrophilic fibrous body 30 appears on the surface 37 of the wet paper web-side layer 31, irrespective of whether the hydrophilic fibrous body 30 projects outward from the surface 37 of the wet paper web-side layer 31 or not. FIG. 5 shows an example of the state in which the hydrophilic fibrous body 30 is exposed on the surface 37 of the wet paper web-side layer 31; the invention is, however, not limited to the illustrated state.

Regarding the belt 1, 1*a*, 1*b*, in order to improve the first function of attaching the wet paper web W to the belts 1, 1*a*, 1*b* and of transferring the wet paper web W and the second function of smoothly releasing the wet paper web W when it is passed to the next process, a hydrophilic fibrous body 30 is formed by needle punching in the wet paper web-side layer 31 of the belts 1, 1*a*, 1*b*.

The wet paper web-side batt layer 38 of the wet paper web-side layer 31 is made from the hydrophilic fibrous body 30; therefore, the wet paper web-side batt layer 38 is of high water absorbability. The wet paper web-side batt layer 38 is impregnated with a high-polymer elastic body 39, and one part of the hydrophilic fibrous body 30 is exposed on the surface 37 of the wet paper web-side layer 31.

As the high-polymer elastic body 39, a thermosetting resin such as urethane, epoxy, acrylic, or the like or a thermoplastic resin such as polyamide, polyarylate, polyester, or the like may be used.

The belts 1, 1*a*, 1*b* are preferably completely impermeable to air; however, depending on the papermaking machine 2, there are also cases in which the belts 1, 1*a*, 1*b* may be slightly permeable to air. In these cases, the desired air permeability is obtained, when the impregnation amount of the high-polymer elastic body 39 is reduced, the surface 37 of the wet paper web-side layer 31 is polished, or a high-polymer elastic body with continuous bubbles is used.

The wet paper web-side batt layer 38, constituting the wet paper web-side layer 31, and a machine-side batt layer 40, constituting the machine-side layer 32, are made of short fibers (staple fibers). The hydrophilic fibrous body 30 is used as the staple fibers of the wet paper web-side batt layer 38. Fibers with a lower official moisture regain than the hydrophilic fibrous body 30 are used as the staple fibers of the machine-side batt layer 40.

The wet paper web-side batt layer 38 is intertwiningly integrated with the wet paper web side of the base fabrics 33, 33*a*, 33*b* by needle punching. The machine-side batt layer 40 is intertwiningly integrated with the machine side (press roll 10 side) of the base fabrics 33, 33*a*, 33*b*. Apart from needle punching, adhesive bonding, electrostatic flocking or the like may be used as means for integrating the wet paper web-side batt layer 38 or the machine-side batt layer 40.

The hydrophilic fibrous body 30 preferably has an official moisture regain of 4% or more. Specifically, the fibers of the hydrophilic fibrous body 30 are selected from the group of hydrophilic fibers consisting of nylon (official moisture regain of 4.5%), vinylon (official moisture regain of 5.0%), acetate (official moisture regain of 6.5%), rayon (official moisture regain of 11.0%), polynosic (official moisture regain of 11.0%), cupra (official moisture regain of 11.0%), cotton (official moisture regain of 8.5%), hemp (official moisture regain of 12.0%), silk (official moisture regain of 12.0%)

and wool (official moisture regain of 15.0%), etc. The numerical values in the brackets represent official moisture regains. If fibers with an official moisture regain of less than 4% are used, the first function of attaching the wet paper web W to the belts 1, 1*a*, 1*b* and of transferring the wet paper web W cannot be sufficiently performed because said fibers cannot sufficiently retain the moisture from the wet paper web W.

In the Examples and Comparative Examples described below, the cases, in which rayon fibers or nylon fibers are used for the wet paper web-side batt layer 38 and the machine-side batt layer 40, are described.

As the hydrophilic fibrous body 30, fibers with chemically hydrophilized surfaces may be used. Specifically, the fiber surfaces may be treated by a mercerizing process, a resinating process, a sputtering process based on ionizing radiation, a glow discharge process, or the like.

When the hydrophilizing process is used, good results can be obtained if the contact angle with water is 30 degrees or less while the moisture of the hydrophilized monofilaments or complex yarns is adjusted to a value between 4 to 5%. The moisture percentage of the monofilaments or the complex yarns is calculated according to the equation: (water/total weight)×100.

After impregnating the wet paper web-side batt layer 38 with the high-polymer elastic body 39 and after curing, the surface of the wet paper web-side batt layer 38 is polished by sandpaper, a grinding stone or the like. To prevent the fibers of the hydrophilic fibrous body 30 from being fibrilized (fragmented) during polishing, it is desirable for the hydrophilic fibrous body 30 to have a strength of 0.8 g/dtex or more.

As a result, at least one part of the hydrophilic fibrous body 30 is exposed on the surface 37 of the wet paper web-side layer 31. Consequently, when the wet paper web W is passed to the next process, the belts 1, 1*a*, 1*b* perform the second function of smoothly releasing the wet paper web W.

A fibrous body 41, used in the machine-side batt layer 40, is made of fibers which are less hydrophilic, i.e. of a lower official moisture regain, than the hydrophilic fibrous body 30 of the wet paper web-side batt layer 38. Specifically, the fibers may be selected whose official moisture regain differs from the official moisture regain of the hydrophilic fibrous body 30 by 4% or more.

Alternatively, the fibers of the fibrous body 41 may be selected from the group of fibers consisting of vinylidene (official moisture regain of 0%), polyvinyl chloride (official moisture regain of 0%), polyethylene (official moisture regain of 0%), polypropylene (official moisture regain of 0%), polyester (official moisture regain of 0.4%), aromatic polyamide (official moisture regain of 0.4%), polyurethane (official moisture regain of 1.0%), acrylic (official moisture regain of 2.0%), or the like, which are of low official moisture regain.

Since the machine-side batt layer 40 is in contact with the press roll 10, a mixture of nylon and other fibers, wherein the nylon fibers which have excellent wear resistance are the principal component, may be used in the machine-side batt layer 40.

The wet paper web-side batt layer 38 constituting the wet paper web-side layer 31 preferably has a basis weight in the range from 50 to 1000 g/m$^2$; and the machine-side batt layer 40 constituting the machine-side layer 32 preferably has a basis weight in the range from 0 to 600 g/m$^2$.

The base fabric according to the present invention is made by stacking together the first woven fabric 34, which is disposed on the wet paper web side, and the second woven fabric 35, which is disposed on the press roll side; the second woven fabric 35 gives mechanical strength to the wet paper web transfer belts 1, 1*a*, 1*b*, while the first woven fabric 34 has the function of suppressing the extension of the belt width and base fabric marking. In other words, the first woven fabric 34 of the present invention suppresses the transfer of the knuckle shapes of the lower fabric (the second woven fabric 35) to the wet paper web when the wet paper web-side batt layer 38 becomes soft due to the water absorption of the hydrophilic fibrous body 30 and pressure is applied in the press part, i.e., the first woven fabric 34 suppresses base fabric marking of the second woven fabric 35.

The first woven fabric 34 according to the present invention, in which the knuckle size of the cross machine direction (CMD) yarn material can be reduced because the machine direction (MD) yarn material is a complex yarn, has the function of dispersing and absorbing the press pressure, and works to suppress the transfer of the knuckle shapes of the lower fabric (the second woven fabric 35) to the wet paper web. The first woven fabric 34 also has the function of suppressing the extension of the belt width because the CMD yarn material is a yarn material of a low water absorption rate.

In FIGS. 2 through 4, the base fabrics 33, 33*a*, 33*b* are made by stacking together the first woven fabric 34 and the second woven fabric 35. The first woven fabric 34 and the second woven fabric 35 are obtained by weaving an MD yarn material 42 and a CMD yarn material 36.

The first woven fabric 34 and the second woven fabric 35 have a structure which consists either of a single weave, a double weave or a triple weave.

The first woven fabric 34 is woven from the MD yarn material 42 and the CMD yarn material 36; the MD yarn material 42 is a complex yarn, and the CMD yarn material 36 is a yarn material of a low water absorption rate.

Here, the complex yarn is either one of a short fiber yarn (spun yarn) or a long fiber yarn (filament yarn); in each case, by twisting and elongating a microfiber, the yarn thickness is maintained, the shape is stabilized, and strength and uniformity are obtained.

In the present invention, the complex yarn is made from short fibers of one or a plurality of the materials: polyamide, polyester, aromatic polyamide, aromatic polyester and polyether ketone. In other words, the complex yarn may comprise one of the above-mentioned materials or may be made by blending a plurality of these materials. It may also be a combined yarn made by twisting a spun yarn and a filament yarn.

The CMD yarn material 36 comprises one or a plurality of materials selected from the group consisting of polyester, aromatic polyamide, aromatic polyester and polyether ketone with a low water absorption rate. In this way, the dimensional extension of the belt width and the base fabric marking due to the water absorbing action of the hydrophilic fibrous body 30 constituting the wet paper web-side batt layer 38 can be suppressed at the same time.

In one example of the combination of the first woven fabric 34 and the second woven fabric 35 in base fabrics 33, 33*a*, 33*b*, the upper fabric (the first woven fabric 34) consists of a single weave, and the lower fabric (the second woven fabric 35) consists of a double weave (FIG. 2). In another example, the upper fabric (the first woven fabric 34) consists of a double weave, and the lower fabric (the second woven fabric 35) consists of a triple weave (FIG. 3). In still another example, the upper fabric (the first woven fabric 34) consists of a single weave, and the lower fabric (the second woven fabric 35) consists of a triple weave (FIG. 4).

EXAMPLES

Figure 6:
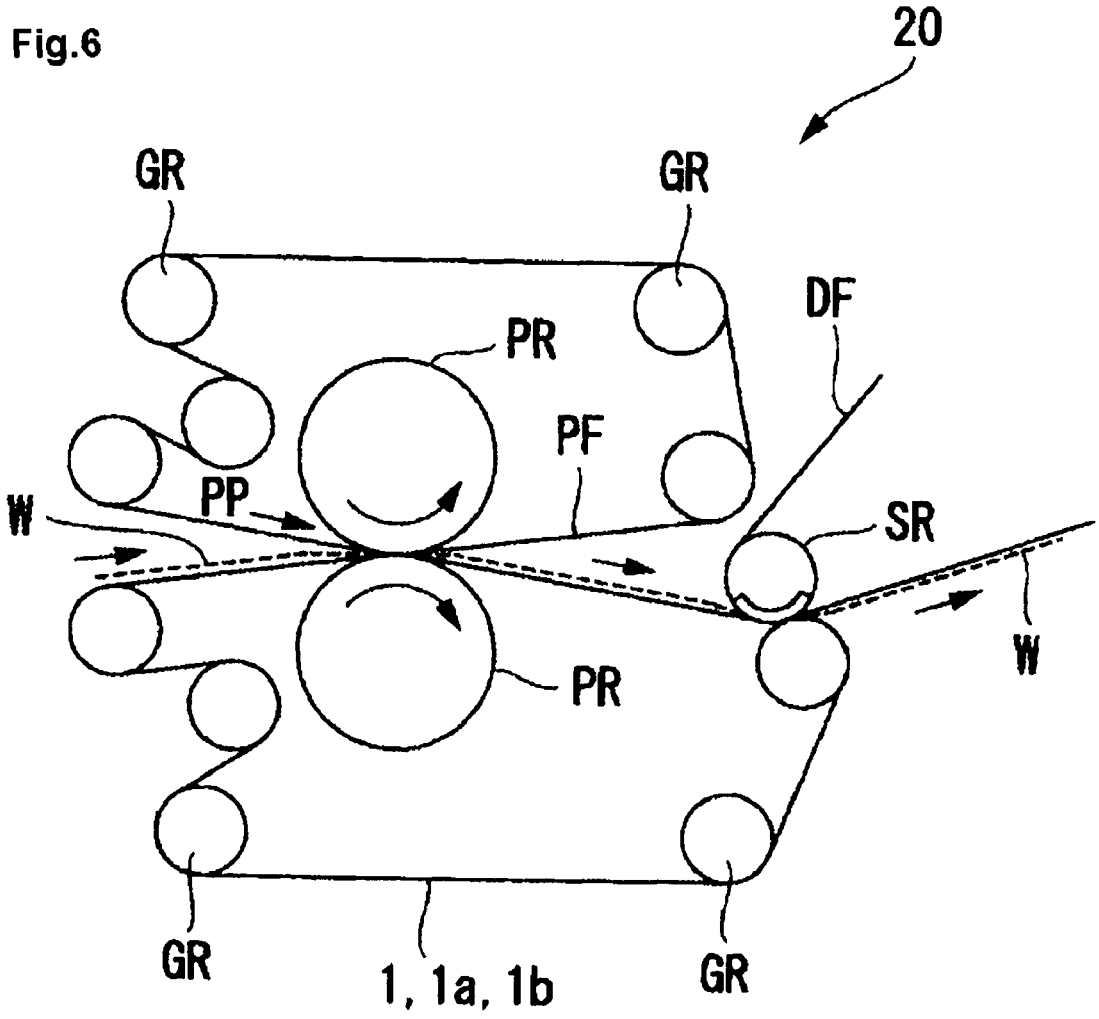
FIG. 6 A schematic view of an experimental device for evaluating the performance of wet paper web transfer belts.

FIG. 6 is a schematic view of an experimental device 20 for evaluating the performance of a wet paper web transfer belt according to the present invention.

The experimental device 20 is made from a pair of press rolls PR, PR forming a press part PP, a press felt PF and belts 1, 1*a*, 1*b*, which are pinched between the press rolls PR, PR.

A plurality of guide rollers GR supports the press felt PF and the belts 1, 1*a*, 1*b* while maintaining a constant tension. The press felt PF and the belt 1, 1*a*, 1*b* are driven by the rotation of the press rolls PR. A dryer fabric DF, which is constituted as an endless shape like the press felt PF and the belts 1, 1*a*, 1*b*, travels while being supported by the guide rollers.

In the experimental device 20, a wet paper web W was placed on the belt 1, 1*a*, 1*b* which is positioned upstream of the press part PP. The wet paper web W was transferred by the belts 1, 1*a*, 1*b* to pass through the press region PP, and thereafter to reach a suction roll SR. The wet paper web W was then passed to the dryer fabric DF due to the attraction of the suction roll SR, dried by a dryer cylinder (not shown in the drawing), and made into paper.

In the experiments, the properties of the wet paper web transfer belts produced in the Examples and in the Comparative Examples were evaluated by the experimental device 20. In other words, the wet paper web transfer belts produced were placed in the experimental device 20, the dimensional behavior of the belt during operation and the base fabric marking condition of the paper made after drying by the dryer fabric were observed, and the results thereof were recorded in the Table.

Example 1

1. Base Fabric 33

The upper fabric (the first woven fabric 34) consisted of a 1/1 single weave structure (the MD yarn material was a 1200 dtex complex yarn (spun yarn) of nylon, the CMD yarn material was a 1200 dtex single monofilament yarn of PET), and had a basis weight of 200 g/m$^2$.

The lower fabric (the second woven fabric 35) consisted of a warp double weave (the MD yarn material was a monofilament twine (twist yarn) of nylon, the CMD yarn material was a monofilament twine of nylon), and had a basis weight of 400 g/m$^2$.

2. Batt Layer

The wet paper web-side batt layer 38 was formed of the rayon fibers of the hydrophilic fibrous body 30 by needle punching, and had a basis weight of 600 g/m$^2$. The machine-side batt layer 40 was formed of nylon fibers by needle punching, and had a basis weight of 250 g/m$^2$.

3. Impregnation of the High-Polymer Elastic Body 39

The wet paper web-side batt layer of the belt formed by needle punching, as described above, was impregnated with a urethane resin at a rate of 500 g/m$^2$ and, thereafter, cured.

Example 2

1. Base Fabric 33*a*

The upper fabric (the first woven fabric 34) consisted of a warp double weave structure (the MD yarn material was a 1200 dtex complex yarn (filament yarn) of nylon, the CMD yarn material was a 1200 dtex single monofilament yarn of PET), and had a basis weight of 400 g/m$^2$.

The lower fabric (the second woven fabric 35) consisted of a warp triple weave structure (the MD yarn material was a monofilament twine of nylon, the CMD yarn material was a single monofilament yarn of nylon), and had a basis weight of 600 g/m$^2$.

2. Batt Layer same as in Example 1.

3. Impregnation of the High-Polymer Elastic Body 39 same as in Example 1.

Example 3

1. Base Fabric 33*b:*

The upper fabric (the first woven fabric 34) consisted of a 1/1 single weave structure (the MD yarn material was a 1200 dtex complex yarn (spun yarn) of nylon, the CMD yarn material was a 1200 dtex single yarn of PET), and had a basis weight of 200 g/m$^2$.

The lower fabric (the second woven fabric 35) consisted of a warp triple weave structure (the MD yarn material was a monofilament twine of nylon, the CMD yarn material was a single monofilament yarn of nylon), and had a basis weight of 600 g/m$^2$.

2. Batt Layer same as in Example 1.

3. Impregnation of the High-Polymer Elastic Body 39 same as in Example 1.

Comparative Example 1

1. Base Fabric

The upper fabric (the wet paper web-side woven fabric) consisted of a 1/1 single weave structure (the MD yarn material was a 1200 dtex monofilament twine of nylon, the CMD yarn material was a 1200 dtex single monofilament yarn of nylon), and had a basis weight of 200 g/m$^2$.

The lower fabric (the roll-side woven fabric) consisted of a warp double weave structure (the MD yarn material was a monofilament twine of nylon, the CMD yarn material was a monofilament twine of nylon), and had a basis weight of 400 g/m$^2$.

2. Batt Layer same as in Example 1.

3. Impregnation of the High-Polymer Elastic Body 39 same as in Example 1.

Comparative Example 2

1. Base Fabric

The upper fabric (the wet paper web-side woven fabric) consisted of a warp double weave structure (the MD yarn material was a 1200 dtex monofilament twine of nylon, the CMD yarn material was a 1200 dtex single monofilament yarn of PET), and had a basis weight of 400 g/m$^2$.

The lower fabric (the roll-side woven fabric) consisted of a warp triple weave structure (the MD yarn material was a monofilament twine of nylon, the CMD yarn material was a monofilament twine of nylon), and had a basis weight of 600 g/m$^2$.

2. Batt Layer same as in Example 1.

3. Impregnation of the High-Polymer Elastic Body 39 same as in Example 1.

TABLE 1

| | Dimensional changes | | Base fabric marking Observation by profile projector | Overall Evaluation |
|---|---|---|---|---|
| | MD | CMD | | |
| Example 1 | +1.5% | +0.7% | Base fabric markings were not visible | Good |
| Example 2 | +1.2% | +0.5% | Base fabric markings were not visible | Good |
| Example 3 | +1.2% | +0.5% | Base fabric markings were not visible | Good |
| Comparative Example 1 | +1.5% | +2.0% | Base fabric markings were visible | Not good (significant CMD extension, visible base fabric marking) |
| Comparative Example 2 | +1.2% | +0.7% | Base fabric markings were visible | Not good (visible base fabric marking) |

Dimensional change: the dimension after the running experiment as compared to the dimension before the traveling experiment (rate of elongation). Observation by profile projector: after the experiment, the paper was placed on a profile projector, rayed and observed. Base fabric markings were considered to be present when the knuckle shape of the lower fabric (the second woven fabric 35) was visible.

According to the experiments conducted by using the experimental device 20, compared to the wet paper web transfer belts according to Comparative Examples 1 and 2, the belts 1, 1*a*, 1*b* using the base fabric 33, 33*a*, 33*b* according to Examples 1 to 3 served to suppress the dimensional extension of the belt width and base fabric markings due to the water absorbing action of the hydrophilic fibrous body, even when a hydrophilic fibrous body of rayon fibers was provided in the wet paper web-side batt layer.

The dimensional change in Comparative Example 2 was small; however, the overall evaluation was not good because base fabric markings were visible.

In other words, compared to the dimensional extension of the belt width of 2.0% of the wet paper web transfer belt according to Comparative Example 1, the dimensional extension of the belt width of the belts 1, 1*a*, 1*b* according to Examples 1 to 3 was 0.5 to 0.7; thus it was understood that the dimensional extension of the belt width was suppressed.

Moreover, compared to the paper obtained with the wet paper web transfer belts according to Comparative Examples 1 and 2, in which base fabric marking appeared, base fabric markings were not visible with the belts according to Examples 1 to 3; thus the effect of the present invention was obtained.

Embodiments (including Examples) of the present invention have been described above; however, the present invention is not limited to these embodiments, and different modifications, additions and the like may be made within the scope of the invention.

In the drawings, identical reference characters denote identical or corresponding parts throughout.

INDUSTRIAL APPLICABILITY

The wet paper web transfer belt according to the present invention can be applied as a belt for transferring a wet paper web in the press part of a closed-draw papermaking machine.

The invention claimed is:

1. A wet paper web transfer belt for transferring a wet paper web used in a closed-draw papermaking machine, comprising:

a base fabric disposed inside as well as a wet paper web-side layer disposed on the wet paper web-side, which includes a hydrophilic fibrous body, and a machine-side layer disposed on the press roll; wherein the base fabric is made by stacking together a first woven fabric disposed on the wet paper side and a second woven fabric disposed on the press roll side, and the first woven fabric is woven from a machine direction yarn material and a cross machine direction yarn material, the machine direction yarn material is a complex yarn, which is made from a short fiber yarn (spun yarn) or which is a combined filament yarn in which the short fiber yarn (spun yarn) and a long fiber yarn (filament yarn) are twisted together, and the cross machine direction yarn material is a yarn material of a low water absorption rate.

2. A wet paper web transfer belt according to claim 1, wherein the complex yarn is made from the short fiber yarn (spun yarn) including one or a plurality of materials selected from the group consisting of polyamide, polyester, aromatic polyamide, aromatic polyester and polyether ketone.

3. A wet paper web transfer belt according to claim 2, wherein the cross machine direction yarn material is a yarn including one or a plurality of materials selected from the group consisting of polyamide, polyester, aromatic polyamide, aromatic polyester and polyether ketone.

4. A wet paper web transfer belt according to claim 3, wherein the first woven fabric includes a single weave structure and the second woven fabric includes a double weave structure.

5. A wet paper web transfer belt according to claim 3, wherein the first woven fabric includes a double weave structure and the second woven fabric includes a triple weave structure.

6. A wet paper web transfer belt according to claim 3, wherein the first woven fabric includes a single weave structure and the second woven fabric includes consists of a triple weave structure.

7. A wet paper web transfer belt according to claim 1, wherein the complex yarn is the combined filament yarn in which the short fiber yarn (spun yarn), including one or a plurality of materials selected from the group consisting of polyamide, polyester, aromatic polyamide, aromatic polyester and polyether ketone, and the long fiber yarn (filament yarn), including one or a plurality of materials selected from the group consisting of polyamide, polyester, aromatic polyamide, aromatic polyester and polyether ketone, are twisted together.

8. A wet paper web transfer belt according to claim 7, wherein the cross machine direction yarn material is a yarn including one or a plurality of materials selected from the group consisting of polyamide, polyester, aromatic polyamide, aromatic polyester and polyether ketone.

9. A wet paper web transfer belt according to claim 8, wherein the first woven fabric includes a single weave structure and the second woven fabric includes a double weave structure.

10. A wet paper web transfer belt according to claim 8, wherein the first woven fabric includes a double weave structure and the second woven fabric includes a triple weave structure.

11. A wet paper web transfer belt according to claim 8, wherein the first woven fabric includes a single weave structure and the second woven fabric includes a triple weave structure.

12. A wet paper web transfer belt according to claim 1, wherein the cross machine direction yarn material is a yarn including one or a plurality of materials selected from the group consisting of polyamide, polyester, aromatic polyamide, aromatic polyester and polyether ketone.

13. A wet paper web transfer belt according to claim 12, wherein the first woven fabric includes a single weave structure and the second woven fabric includes a double weave structure.

14. A wet paper web transfer belt according to claim 12, wherein the first woven fabric includes a double weave structure and the second woven fabric includes a triple weave structure.

15. A wet paper web transfer belt according to claim 12, wherein the first woven fabric includes a single weave structure and the second woven fabric includes a triple weave structure.

16. A wet paper web transfer belt according to claim 1, wherein the first woven fabric includes a single weave structure and the second woven fabric includes a double weave structure.

17. A wet paper web transfer belt according to claim 1, wherein the first woven fabric includes a double weave structure and the second woven fabric includes a triple weave structure.

18. A wet paper web transfer belt according to claim 1, wherein the first woven fabric includes a single weave structure and the second woven fabric includes a triple weave structure.

19. A wet paper web transfer belt according to claim 1, wherein the hydrophilic fibrous body includes an official moisture regain of 4% or more.

* * * * *